US009709048B2

(12) United States Patent
Kinjo

(10) Patent No.: US 9,709,048 B2
(45) Date of Patent: Jul. 18, 2017

(54) SEALED COMPRESSOR WITH A SUCTION MUFFLER COMPRISING AN INSULATING SPACE

(75) Inventor: Kenji Kinjo, Shiga (JP)

(73) Assignee: PANASONIC CORPORATION, Osaka (JP)

( * ) Notice: Subject to any disclaimer, the term of this patent is extended or adjusted under 35 U.S.C. 154(b) by 344 days.

(21) Appl. No.: 14/342,275

(22) PCT Filed: Sep. 5, 2012

(86) PCT No.: PCT/JP2012/005627
§ 371 (c)(1),
(2), (4) Date: Feb. 28, 2014

(87) PCT Pub. No.: WO2013/035323
PCT Pub. Date: Mar. 14, 2013

(65) Prior Publication Data

US 2014/0212308 A1 Jul. 31, 2014

(30) Foreign Application Priority Data

Sep. 9, 2011 (JP) ..... 2011-196825

(51) Int. Cl.
*F04B 39/00* (2006.01)
*F04B 35/04* (2006.01)

(52) U.S. Cl.
CPC ..... *F04B 35/04* (2013.01); *F04B 39/0061* (2013.01)

(58) Field of Classification Search
CPC ... F04B 35/04; F04B 39/0055; F04B 39/0061
(Continued)

(56) References Cited

U.S. PATENT DOCUMENTS 4,313,715 A 2/1982 Richardson
4,370,104 A * 1/1983 Nelson ..... F04B 39/0027 181/403
(Continued)

FOREIGN PATENT DOCUMENTS

CN 1896504 1/2007
CN 101684788 3/2010
(Continued)

OTHER PUBLICATIONS

Chinese Office Action, Aug. 5, 2015, Chinese Patent Application No. 201280043571.2 with English translation (17 pages).

*Primary Examiner* — William H Rodriguez
*Assistant Examiner* — Joseph Herrmann
(74) *Attorney, Agent, or Firm* — Hamre, Schumann, Mueller & Larson, P.C.

(57) ABSTRACT

A sealed compressor of the present invention comprises an electric component (103); a compression component (105); a sealed container (101); and a suction pipe (115); wherein the compression component (105) includes a compression chamber (141), and a suction muffler (115) through which a refrigerant gas flows; wherein the suction muffler (157) includes a muffler body (165) in which a muffling space (163) is formed, a tail pipe (159) through which a refrigerant gas is introduced into the muffling space (163); and a muffler cover (169) provided to surround the muffler body (165) such that a first space (167) is formed between the muffler cover (169) and the muffler body (165); wherein the muffler cover (169) is provided with a refrigerant inlet (175) in a portion which faces an outlet (117) of the suction pipe (115) and is in the vicinity of a suction port (171) of a tail pipe (159), the refrigerant inlet communicating the interior of the sealed container (101) with the first space (167).

6 Claims, 5 Drawing Sheets

(58) Field of Classification Search
USPC ..... 181/403; 417/312
See application file for complete search history.

(56) References Cited

U.S. PATENT DOCUMENTS

| | | | | | |
|---|---|---|---|---|---|
| 4,784,583 | A | | 11/1988 | Bar | |
| 5,252,035 | A | * | 10/1993 | Lee | F04B 39/0044 181/403 |
| 5,344,289 | A | * | 9/1994 | Fasce | F04B 39/0055 181/403 |
| 5,496,156 | A | * | 3/1996 | Harper | F04B 39/0055 181/403 |
| 5,499,908 | A | * | 3/1996 | Schmitz, III | C10M 169/041 184/6.23 |
| 5,971,720 | A | * | 10/1999 | Fagotti | F04B 39/0055 181/403 |
| 7,316,291 | B2 | * | 1/2008 | Thomsen | F04B 39/0061 181/229 |
| 2007/0014678 | A1 | | 1/2007 | Seo | |

FOREIGN PATENT DOCUMENTS

| | | |
|---|---|---|
| JP | 56-104182 | 8/1981 |
| JP | 06-117372 | 4/1994 |
| JP | 11-303739 | 11/1999 |
| JP | 2003-097430 | 4/2003 |

* cited by examiner

Prior Art

SEALED COMPRESSOR WITH A SUCTION MUFFLER COMPRISING AN INSULATING SPACE

TECHNICAL FIELD

The present invention relates to a configuration of a sealed compressor for use in electric refrigerator-freezers for household uses, show cases, etc. Particularly, the present invention relates to a configuration of a suction muffler of the sealed compressor.

BACKGROUND ART

In recent years, there have been increasing demands for global environmental conservation. Sealed compressors for use in electric refrigerator-freezers for household uses, other refrigeration units, etc. are required to have a higher efficiency.

To address such an increase in the energy efficiency, there is known a sealed compressor including a first suction muffler and a second suction muffler provided to surround the first suction muffler (see e.g., Patent Literature 1). Hereinafter, the sealed compressor disclosed in Patent Literature 1 will be described with reference to FIGS. 4 and 5.

FIG. 4 is a cross-sectional view showing a schematic configuration of the sealed compressor disclosed in Patent Literature 1. FIG. 5 is a cross-sectional view showing a schematic configuration of a suction muffler of the sealed compressor of FIG. 4. In FIG. 4, upper and lower sides in FIG. 4 are upper and lower sides of the sealed compressor.

Firstly, the configuration of the sealed compressor disclosed in Patent Literature 1 will be described with reference to FIG. 4.

As shown in FIG. 4, the sealed compressor disclosed in Patent Literature 1 includes a sealed container 1 and a compressor body 5. In an interior of the sealed container 1, a refrigerant gas 3 is filled, and the compressor body 5 is elastically supported on the sealed container 1 by a suspension ring (not shown). The compressor body 5 includes an electric component 7 and a compression component 9 disposed below the electric component 7.

The electric component 7 includes a stator 11 and a rotor 13. The compression component 9 includes a block 17 defining a cylinder 15, a piston 19 which is reciprocatable within the cylinder 15, a valve plate 21 which closes an end surface of the cylinder 15, a cylinder head 23 covering the valve plate 21, a suction muffler 25, a crankshaft 31 having an eccentric shaft 27 and a main shaft 29, and a joining means 33 for joining the eccentric shaft 27 and the piston 19 to each other.

A compression chamber 35 is defined by the cylinder 15, the valve plate 21, and the piston 19. The suction muffler 25 is retained between the valve plate 21 and the cylinder head 23.

Next, the suction muffler 25 of the sealed compressor disclosed in Patent Literature 1 will be described in detail, with reference to FIG. 5.

As shown in FIG. 5, the suction muffler 25 includes a first suction muffler 37, a muffler entrance passage 39, which is in communication with the first suction muffler 37, a muffler exit passage 41 having an end which opens in an interior of the first suction muffler 37, a second suction muffler 45 provided to surround the first suction muffler 37, and a communication passage 47 for communicating the muffler exit passage 41 and the second suction muffler 45 with each other. In this structure, the first suction muffler 37 is thermally insulated by a wall surface of the second suction muffler 45 and by the refrigerant gas staying in a space 43 between the first suction muffler 37 and the second suction muffler 45.

Because of this structure, in the sealed compressor disclosed in Patent Literature 1, it is possible to suppress the low-temperature refrigerant gas flowing through the first suction muffler 37 from being heated by the high-temperature refrigerant gas in the interior of the sealed container 1.

CITATION LIST

Patent Literature

Patent Literature 1: Japanese-Laid Open Patent Application Publication No. Hei. 11-303739

SUMMARY OF INVENTION

Technical Problem

However, in the sealed compressor disclosed in Patent Literature 1, since the muffler exit passage 41 is in communication with the second suction muffler 45, the refrigerant gas 3 in the space 43 which is heated by the electric component 7 and the high-temperature refrigerant gas in the interior of the sealed container 1 flows into the muffler exit passage 41 via the communication passage 47, due to pulsation of the refrigerant gas 3 in the interior of the suction muffler 25. This causes the refrigerant gas 3 flowing in the muffler exit passage 41 to increase in temperature, so that the refrigerant gas 3 suctioned into the compression chamber 35 decreases in density. Because of this, there exists a problem that a sufficient effect of the space 43 cannot be attained, and a volumetric efficiency cannot be increased so much.

Although Patent Literature 1 discloses that the communication passage 47 may be provided in the muffler entrance passage 39 instead of the muffler exit passage 41, a sufficient effect of the space 43 cannot be attained, and a volumetric efficiency cannot be increased so much, as in the above case.

The present invention is directed to solving the problems associated with the prior art, and an object is to provide a sealed compressor which is capable of suppressing a temperature increase in a refrigerant gas supplied to a compression chamber and thereby performing high-efficient running.

Solution to Problem

To solve the above problem associated with the prior art, there is provided a sealed compressor comprising: an electric component; a compression component actuated by the electric component; a sealed container accommodating the electric component and the compression component; and a suction pipe which is provided to penetrate a wall portion of the sealed container, and through which a refrigerant gas suctioned into the sealed container flows; wherein the compression component includes a compression chamber formed within a cylinder and a suction muffler through which the refrigerant gas flows from an interior of the sealed container to an interior of the compression chamber; wherein the suction muffler includes a muffler body in which a muffling space is formed, a tail pipe through which the refrigerant gas is introduced into the muffling space; and a muffler cover provided to surround the muffler body such that a first space is formed between the muffler cover and the muffler body; wherein the tail pipe is provided such that a suction port which is one end thereof opens in the interior of the sealed container; and wherein the muffler cover is provided with a refrigerant inlet in a portion which faces an exit of the suction pipe and is in the vicinity of the suction port of the tail pipe, the refrigerant inlet communicating the interior of the sealed container with the first space.

In this configuration, the refrigerant gas introduced from the refrigerant inlet to the first space can suppress the refrigerant gas flowing through the interior of the suction muffler from being heated by the electric component or the high-temperature refrigerant gas in the interior of the sealed container, and the refrigerant gas in the first space which is heated by the electric component or the like can be suppressed from flowing into the suction muffler. Therefore, a temperature increase in the refrigerant gas flowing through the interior of the suction muffler (flowing into the compression chamber), can be suppressed, and a volumetric efficiency can be increased.

Advantageous Effects of Invention

A sealed compressor of the present invention can suppress a temperature increase in the refrigerant gas flowing through the interior of the suction muffler, and thereby improve a volumetric efficiency. Therefore, the efficiency of the sealed compressor can be increased.

DESCRIPTION OF EMBODIMENTS

Figure 1:
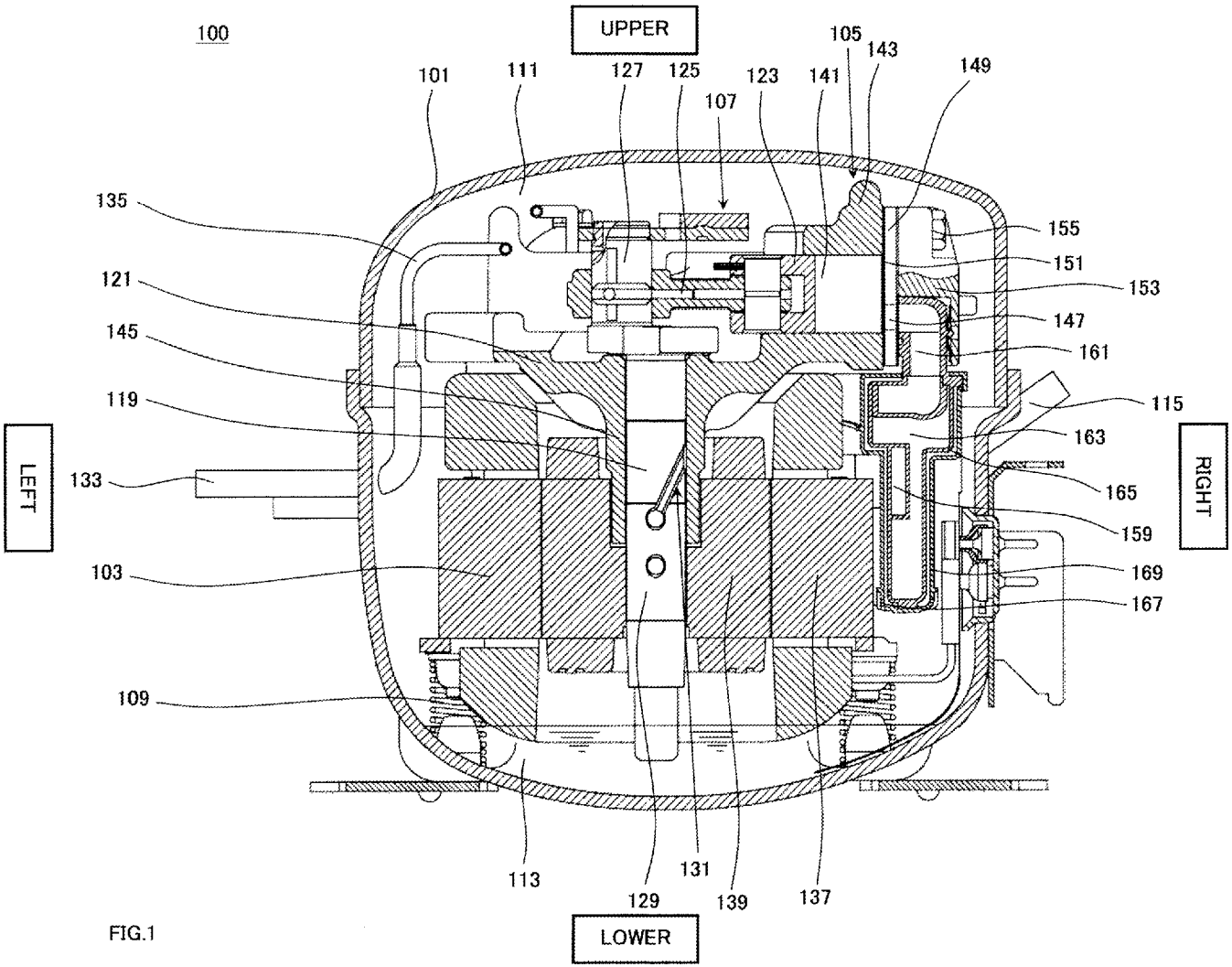
FIG. 1 is a vertical sectional view of a sealed compressor according to Embodiment 1.

A sealed compressor of the present invention comprises: an electric component; a compression component actuated by the electric component; a sealed container accommodating the electric component and the compression component; and a suction pipe which is provided to penetrate a wall portion of the sealed container, and through which a refrigerant gas suctioned into the sealed container flows; wherein the compression component includes a compression chamber formed within a cylinder and a suction muffler through which the refrigerant gas flows from an interior of the sealed container to an interior of the compression chamber; wherein the suction muffler includes a muffler body in which a muffling space is formed, a tail pipe through which the refrigerant gas is introduced into the muffling space; and a muffler cover provided to surround the muffler body such that a first space is formed between the muffler cover and the muffler body; wherein the tail pipe is provided such that a suction port which is one end thereof opens in the interior of the sealed container; and wherein the muffler cover is provided with a refrigerant inlet in a portion which faces an exit of the suction pipe and is in the vicinity of the suction port of the tail pipe, the refrigerant inlet communicating the interior of the sealed container with the first space.

In this configuration, the refrigerant gas introduced from the refrigerant inlet to the first space can suppress the refrigerant gas flowing through the interior of the muffler body from being heated by the electric component or the high-temperature refrigerant gas in the interior of the sealed container, and the refrigerant gas in the first space can be suppressed from flowing into the muffler body. Therefore, a temperature increase in the refrigerant gas flowing through the interior of the muffler body (flowing into the compression chamber), can be suppressed, and a volumetric efficiency of the sealed compressor can be increased. As a result, the efficiency of the sealed compressor can be increased.

In the sealed compressor of the present invention, the muffler cover may be further provided with a refrigerant outlet through which the refrigerant is discharged from the first space to the interior of the sealed container; and the refrigerant inlet may be provided in a location which is closer to the suction port of the tail pipe than the refrigerant outlet.

This configuration makes it possible to discharge to the interior of the sealed container, the refrigerant gas heated by the electric component and the high-temperature refrigerant gas in the interior of the sealed container, from the refrigerant outlet. Therefore, the high-temperature refrigerant gas is suppressed from staying in the first space. Since the high-temperature refrigerant gas is discharged, the low-temperature refrigerant gas can be introduced from the refrigerant inlet to the first space. As a result, it becomes possible to attain a cooling effect in addition to a heat insulating effect by the refrigerant gas. As a result, a volumetric efficiency can be further increased.

In the sealed compressor of the present invention, the electric component may be disposed below the compression component; and the refrigerant inlet may be provided in a portion of the muffler cover which is between the suction port of the tail pipe and the electric component.

In such a configuration, since the low-temperature refrigerant gas can be introduced to, especially, a portion of the suction muffler which is closer to the electric component which tends to be high in temperature, the heat insulating effect can be attained more effectively, and the volumetric efficiency can be increased.

In the sealed compressor of the present invention, the refrigerant outlet may be provided in a location which is most distant from the refrigerant inlet.

In the sealed compressor of the present invention, a flow direction of the refrigerant gas induced in the interior of the sealed container according to a rotation of the electric component, and a flow direction of the refrigerant gas from the refrigerant inlet to the refrigerant outlet through the first space may conform to each other in a macroscopic manner.

In such a configuration, due to the flow of the refrigerant gas in the interior of the sealed container, replacement of the refrigerant gas in the first space can be facilitated. Therefore, a more heat insulating effect can be attained and the volumetric efficiency can be increased.

Hereinafter, the embodiment of the present invention will be described with reference to the drawings. The present invention is not limited to the embodiment below.

Embodiment 1

[Configuration of Sealed Compressor]

Figure 2:
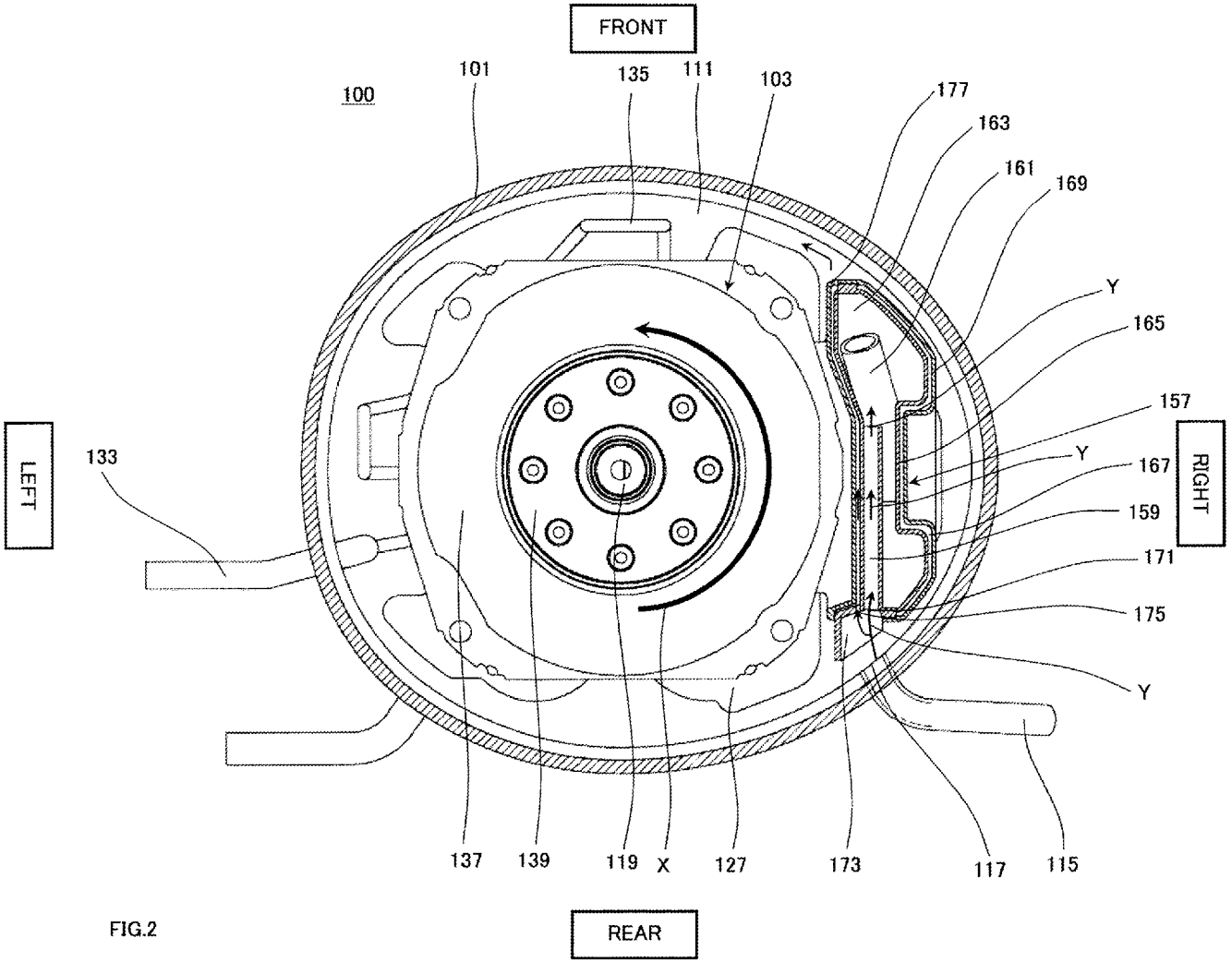
FIG. 2 is a horizontal sectional view of the sealed compressor according to Embodiment 1.
Figure 3:
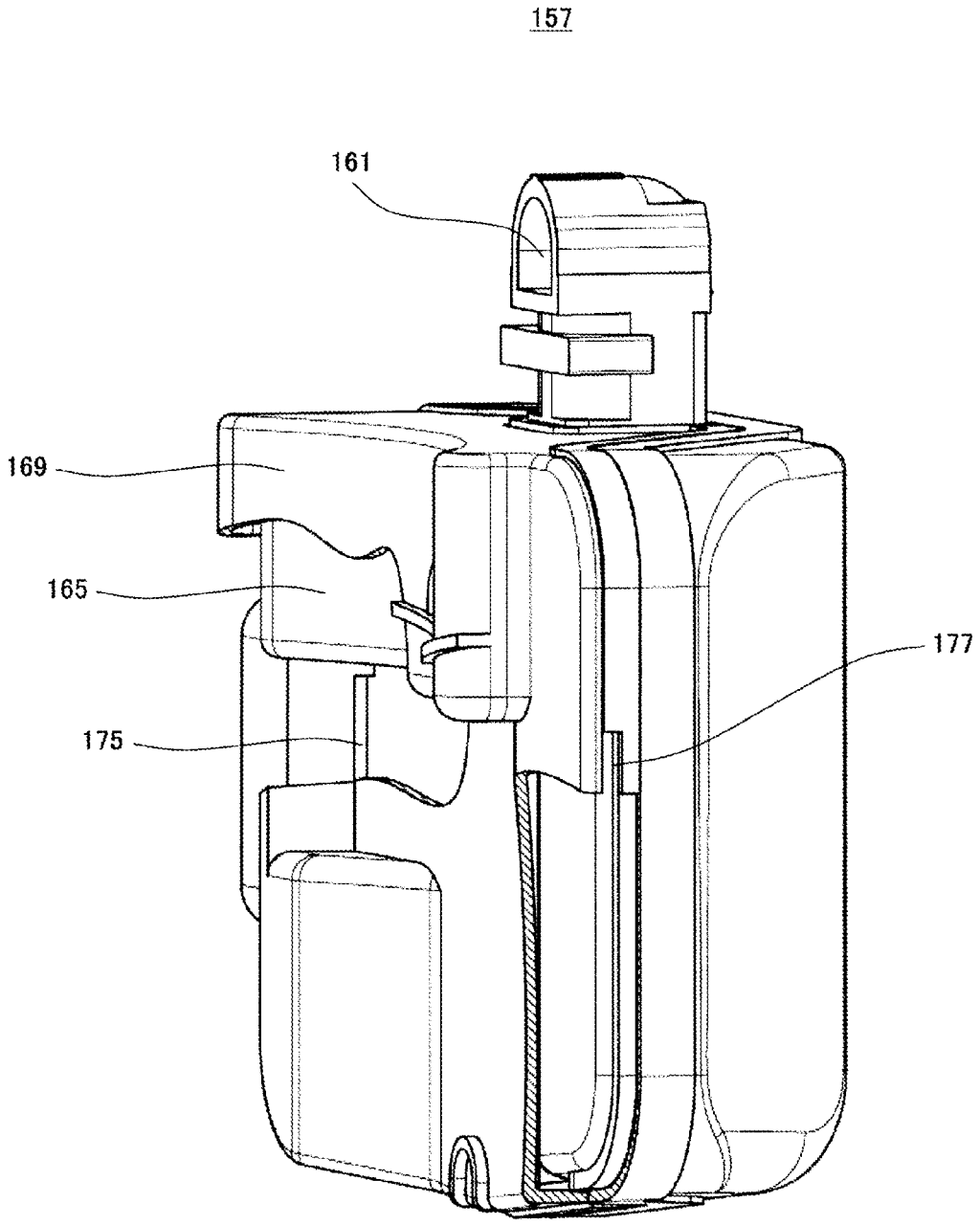
FIG. 3 is a schematic sectional view of a portion of a suction muffler of FIG. 1.
Figure 4:
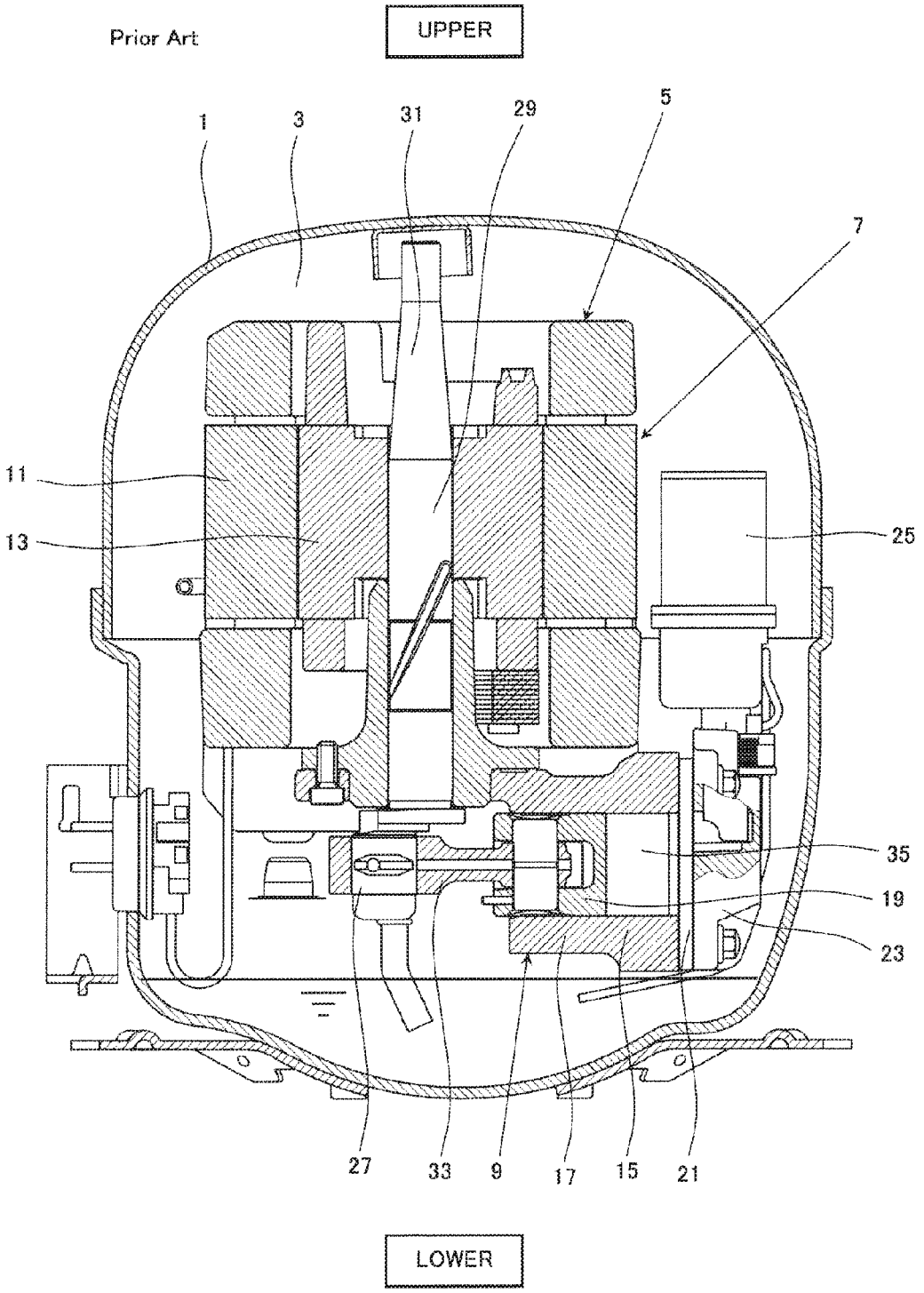
FIG. 4 is a cross-sectional view showing a schematic configuration of a sealed compressor disclosed in Patent Literature 1.
Figure 5:
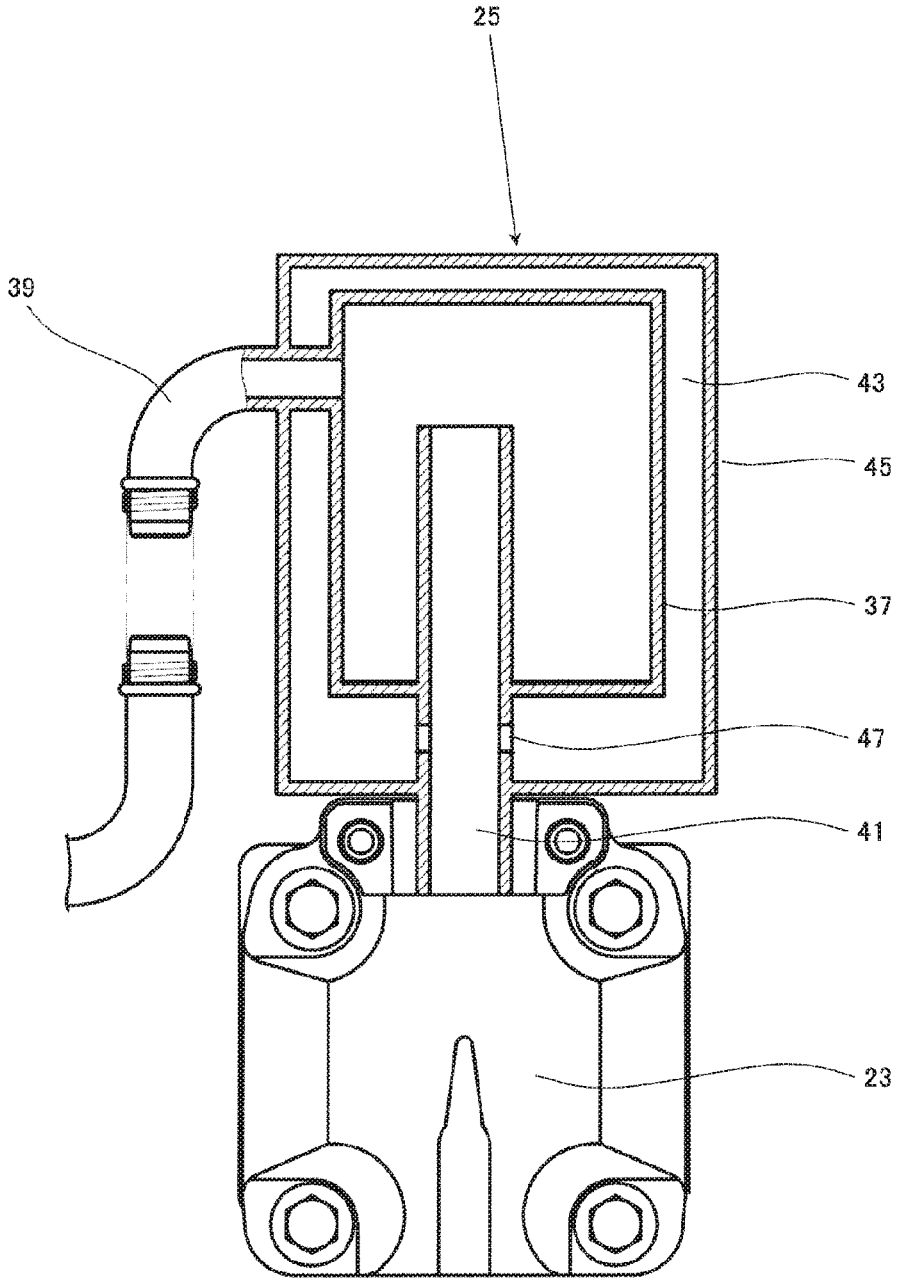
FIG. 5 is a cross-sectional view showing a schematic configuration of a suction muffler of the sealed compressor of FIG. 4.

FIG. 1 is a vertical sectional view of a sealed compressor according to Embodiment 1. FIG. 2 is a horizontal sectional view of the sealed compressor according to Embodiment 1, when viewed from a bottom surface side of the sealed compressor. FIG. 3 is a schematic sectional view of a portion of a suction muffler of FIG. 1.

In FIG. 1, the upper and lower sides and the right and left sides are the upper and lower sides and the right and left sides of the sealed compressor. In FIG. 2, the front and rear sides, and the right and left sides are the front and rear sides and the right and left sides of the sealed compressor.

As shown in FIGS. 1 to 3, a sealed compressor 100 according to Embodiment 1 includes a sealed container 101 and a compressor body 107, and is configured in such a manner that a discharge pipe 133 and a suction pipe 115 as will be described later are connected to a refrigeration unit (not shown) having a well-known configuration, thus forming a refrigeration cycle.

The sealed container 101 is manufactured by a drawing process of an iron plate. The compressor body 107 includes an electric component 103 and a compression component 105 actuated by the electric component 103, and is elastically supported on the sealed container 101 by a suspension ring 109.

The sealed container 101 is filled with, for example, a refrigerant gas 111 such as hydrocarbon-based R600a which is low in global warming potential. Lubricating oil 113 is stored in a bottom portion of the sealed container 101.

The sealed container 101 is provided with a suction pipe 115 which communicates an interior and an exterior of the sealed container 101. A refrigerant gas supplied from a refrigeration unit (not shown) flows through the suction pipe 115. An opening 117 which is a downstream end (exit) of the suction pipe 115 opens in the interior of the sealed container 101.

The electric component 103 is disposed at a lower side in the interior of the sealed container 101 and includes a block 121, a stator 137 and a rotor 139. The block 121 is integrally provided with a cylinder 143 defining the compression chamber 141, and with a bearing unit 145 for supporting the main shaft 129 such that the main shaft 129 is rotatable. The stator 137 is fastened to a lower side of the block 21 by means of a bolt (not shown). The rotor 139 is shrink-fitted and fastened to the main shaft 129 as will be described later such that the rotor 139 is coaxial with the stator 137, in a position inward relative to the stator 137.

The compression component 105 is placed above the electric component 103 and includes a crankshaft 119, the block 121, the piston 123, a joining means 125, etc. A high-pressure pipe 135 is connected to the compression component 105 to flow the refrigerant gas 111 compressed by a reciprocation motion of the piston 123 to the discharge pipe 133 fastened to the sealed container 101.

The crankshaft 119 includes the main shaft 129 having an axis oriented vertically, the eccentric shaft 127, and an oil feeding mechanism 131 which communicates a lower end of the main shaft 129 immersed in the oil 113 and an upper end of the eccentric shaft 127. The oil feeding mechanism 131 is formed by a spiral groove or the like provided on a surface of the main shaft 129, and is configured to feed the oil 113 to the bearing unit 145, or the like.

The block 121 is provided with the bearing unit 145 having a cylindrical inner surface and having an axis oriented vertically. The main shaft 129 of the crankshaft 119 is rotatably inserted into the bearing unit 145.

The block 121 is provided with the cylindrical cylinder 143 having an axis oriented horizontally. The piston 123 is inserted into the cylinder 143 such that the piston 123 is advanceable and retractable. The eccentric shaft 127 is connected to the piston 123 via the joining means 125.

A valve plate 149 having a suction hole 147 and a discharge hole (not shown), a suction valve 151 for opening and closing the suction hole 147, and a cylinder head 153 disposed to cover the valve plate 149 are fitted together by means of a bolt to an end surface of the cylinder 143 which is distant from the crankshaft 119. The suction muffler 157 is retained between the valve plate 149 and the cylinder head 153. The valve plate 149 and the piston 123 define the compression chamber 141.

The suction muffler 157 is mainly formed of a synthetic resin such as PBT added with glass fibers, and includes a muffler body 165, a tail pipe 159 and a communication pipe 161. The muffler body 165 has a rectangular parallelepiped shape which is elongated laterally and has a predetermined thickness. An internal space of the muffler body 165 defines a muffling (silencing) space.

The tail pipe 159 has a tubular shape and is disposed such that one end thereof opens in the muffling space 163 and the suction port 171 which is the other end opens in the sealed container 101. The tail pipe 159 is configured such that a wall portion thereof which is closer to the electric component 103 is formed by a wall portion of the muffler body 165.

A refrigerant receiver section 173 is provided around the suction port 171. Specifically, the refrigerant receiver section 173 is placed to face the opening 117 of the suction pipe 115 with a gap with the opening 117. The communication pipe 161 has a tubular shape. One end of the communication pipe 161 opens in the muffling space 163, while the other end of the communication pipe 161 is in communication with the compression chamber 141.

The suction muffler 157 includes a muffler cover 169 placed outside of the muffler body 165. The muffler cover 169 is placed to surround the muffler body 165 such that a first space which is a heat insulating layer 167 is formed between the muffler cover 169 and the muffler body 165. The muffler cover 169 is provided with a refrigerant inlet 175 and a refrigerant outlet 177 which communicate the interior of the sealed container 101 and the heat insulating layer 167 with each other.

As shown in FIG. 2, the refrigerant inlet 175 is provided in a location which faces the opening 117 of the suction pipe 115 and is in the vicinity of the refrigerant inlet 175 of the tail pipe 159. More specifically, the refrigerant inlet 175 is provided in a portion (portion of the muffler cover 169 which is closer to the center of the sealed container 101) of the muffler cover 169 which is closer to the electric component 103. In other words, the refrigerant inlet 175 is provided in the muffler cover 169 in a location between the suction port 171 of the tail pipe 159 and the electric component 103 (stator 137).

With this structure, a first space is formed between the tail pipe 159 and the electric component 103. Therefore, heat radiated from the electric component 103 can be insulated by the heat insulating layer 167 (first space), which can suppress the refrigerant gas 111 flowing through the tail pipe 159 from being heated.

The refrigerant outlet 177 is provided in a portion of the muffler cover 169 which is more distant from the opening 117 of the suction pipe 115 than the refrigerant inlet 175 of the muffler cover 169. More specifically, the refrigerant outlet 177 is provided in a portion of the muffler cover 169 which is most distant from the refrigerant inlet 175.

The refrigerant inlet 175 and the refrigerant outlet 177 are provided in the muffler 169 so that a flow direction of the refrigerant gas induced in the interior of the sealed container 101 according to the rotation of the electric component 103 (to be precise, crankshaft 119), and a flow direction of the refrigerant gas from the refrigerant inlet 175 to the refrigerant outlet 177 conform to each other in a macroscopic manner (as a whole).

To be in greater detail, as shown in FIG. 2, the suction muffler 157 is disposed at a right side portion of the sealed container 101. The refrigerant inlet 175 is located below the refrigerant outlet 177, and therefore, the refrigerant gas flows in an upward direction from the refrigerant inlet 175 to the refrigerant outlet 177.

In Embodiment 1, the crankshaft 119 is configured to rotate counterclockwise when viewed from below the sealed compressor 100. This causes the refrigerant gas to also flow counterclockwise around the crankshaft 119. At this time, at a right side portion of the sealed container 101, the refrigerant gas flows in an upward direction as a whole (flow direction X). In this case, the flow direction of the refrigerant gas 111 induced in the interior of the sealed container 101 and the flow direction of the refrigerant gas 111 from the refrigerant inlet 175 to the refrigerant outlet 177 through the first space conform to each other in a macroscopic manner (conform to each other as a whole).

For example, in the example of FIG. 2, it is assumed that the suction muffler 157 is disposed at an upper portion of the sealed container 101 and the refrigerant inlet 175 is located at a right side of the refrigerant outlet 177. In this case, the refrigerant gas flows from right to left, from the refrigerant inlet 175 to the refrigerant outlet 177.

As described above, since the crankshaft 119 is configured to rotate counterclockwise, the flow direction of the refrigerant gas induced in the interior of the sealed container 101, and the flow direction of the refrigerant gas from the refrigerant inlet 175 to the refrigerant outlet 177 through the first space conform to each other in a macroscopic manner (as a whole).

As should be understood from the above, by considering the rotation direction of the crankshaft 119 and the location of the suction muffler 157, the location of the refrigerant inlet 175 and the location of the refrigerant outlet 177 are set so that the flow direction of the refrigerant gas induced in the interior of the sealed container 101, and the flow direction of the refrigerant gas from the refrigerant inlet 175 to the refrigerant outlet 177 through the first space conform to each other in a macroscopic manner (as a whole).

[Operation and Advantages of Sealed Compressor]

Next, an operation and advantages of the sealed compressor 100 of Embodiment 1 configured above will be described.

Initially, when the electric component 103 is applied with a current, the current flows through the stator 137, to generate a magnetic field, causing the rotor 139 fastened to the main shaft 129 to rotate. According to the rotation of the rotor 139, the crankshaft 119 rotates, and a rotational motion of the eccentric shaft 127 is converted into a linear reciprocation motion via the joining means 125. The piston 123 reciprocates within the cylinder 143.

The refrigerant gas 111 which has flowed through the suction pipe 115 and returned to the interior of the sealed container 101 is suctioned to the interior of the compression chamber 141 via the suction muffler 157, according to the reciprocation motion of the piston 123. The refrigerant gas suctioned to the interior of the compression chamber 141 is compressed therein and then flows to the discharge pipe 133 via the high-pressure pipe 135. Then, the refrigerant gas flows from the discharge pipe 133 to the suction pipe 115 via a refrigerant unit.

Next, a suction stroke and a compression stroke of the sealed compressor 100 will be descried more specifically.

When the piston 123 moves in a direction to increase a volume of the compression chamber 141, the refrigerant gas 111 in the interior of the compression chamber 141 expands. When a pressure in the interior of the compression chamber 141 falls below a suction pressure, the suction valve 151 starts to open due to a difference between the pressure in the interior of the compression chamber 141 and the pressure in the interior of the suction muffler 157.

According to this operation, the low-temperature refrigerant gas 111 which has returned from the refrigeration cycle is released to the interior of the sealed container 101 from the opening 117 of the suction pipe 115. Then, the refrigerant gas 111 is suctioned from the suction port 171 of the suction muffler 157 and introduced into the muffling space 163 via the tail pipe 159. The introduced refrigerant gas 111 flows into the compression chamber 141 through the communication pipe 161.

After that, when the piston 123 moves from a bottom dead center in a direction to reduce the volume of the interior of the compression chamber 141, the refrigerant gas 111 is compressed in the interior of the compression chamber 141, so that the pressure in the interior of the compression chamber 141 increases. Then, when the pressure in the interior of the compression chamber 141 exceeds the pressure in the interior of the suction muffler 157, the suction valve 151 is closed.

In general, to ensure a sufficient volume of the muffler body 165, the suction muffler 157 is typically disposed in the interior of the sealed container 101, in the vicinity of the stator 137 (electric component 103) where a space is easily ensured. This causes a side surface of the muffler body 165 which is closer to the stator 137 to be heated by heat generation in the stator 137. As a result, the refrigerant gas 111 introduced into the muffling space 163 is heated via the side surface of the muffler body 65 which is closer to the stator 137, and thus the temperature of the refrigerant gas 111 increases.

In a case where the tail pipe 159 is disposed in a location closer to the stator 137, as in Embodiment 1, the refrigerant gas 111 is typically heated and its temperature rises while the refrigerant gas 111 is flowing through the tail pipe 159.

When the temperature of the refrigerant gas 111 flowing into the compression chamber 141 rises, the density of the refrigerant gas 111 flowing into the compression chamber 141 decreases, so that a volume efficiency degrades.

However, in Embodiment 1, the refrigerant gas 111 released to the interior of the sealed container 101 from the opening 117 of the suction pipe 115 flows to the refrigerant receiver section 173 which faces the opening 117, and thereafter is divided to flow to the suction port 171 and to the refrigerant inlet 175 as indicated by an arrow Y shown in FIG. 2.

Then, the refrigerant gas flowing to the refrigerant inlet 175 is introduced into the first space and forms the heat insulating layer 167. The heat insulating layer 167 can suppress the refrigerant gas 111 flowing through the interior of the muffler body 165 from being heated by heat generated in the stator 137.

Since in Embodiment 1, the refrigerant inlet 175 is provided in the vicinity of the suction port 171, the direction of the refrigerant gas flowing from the refrigerant inlet 175 into the first space and the direction of the refrigerant gas flowing through the interior of tail pipe 159 from the suction port 171 substantially conform to each other. In this configuration, even when the refrigerant gas 111 pulsates in the interior of the suction muffler 157, it becomes possible to prevent a situation in which the refrigerant gas 111 flows from the refrigerant inlet 175 to the sealed container 101, and does not flow into the suction port 171, and the refrigerant gas 111 within the heat insulating layer 167 flows into the muffler body 165 and is mixed with the refrigerant gas in the interior of the muffler body 165. Therefore, a temperature increase in the refrigerant gas 111 can be suppressed.

Because of the above results, since it becomes possible to reduce an increase in a specific volume of the refrigerant gas 111 suctioned into the compression chamber 141, the volumetric efficiency can be improved, and hence the efficiency of the sealed compressor 100 can be improved.

In Embodiment 1, since the refrigerant inlet 175 is disposed in a location closer to the electric component 103, the low-temperature refrigerant gas 111 can be introduced into a portion of the suction muffler 157, which is closer to the electric component 103 which tends to be high in temperature. As a result, the volumetric efficiency can be further improved.

Since the muffler cover 169 is provided with the refrigerant outlet 177 which communicates the sealed container 101 and the first space with each other, in a location which is more distant from the opening 117 of the suction pipe 115 than the refrigerant inlet 175 of the muffler cover 169, the refrigerant gas 111 flowing from the refrigerant inlet 175 into the first space can be discharged from refrigerant outlet 177 to the interior of the sealed container 101.

This makes it possible to discharge to the sealed container 101, the refrigerant gas 111 within the first space which is heated by the electric component 103 or the high-temperature refrigerant gas in the interior of the sealed container 101. Thus, the low-temperature refrigerant gas can be introduced with a larger amount from the refrigerant inlet 175 to the first space. As a result, it becomes possible to more effectively suppress a temperature increase in the refrigerant gas 111 flowing through the interior of the muffler body 165.

In Embodiment 1, by providing the refrigerant inlet 175 in a location which is most distant from the refrigerant outlet 177, the flow of the refrigerant gas 111 in the first space can be made more active. This allows a most part of the refrigerant gas 111 increased in temperature in the first space to be replaced by the refrigerant gas 111 which is lower in temperature, during the operation of the sealed compressor 100. As a result, it becomes possible to more effectively suppress a temperature increase in the refrigerant gas 111 flowing through the interior of the muffler body 165.

Further, in Embodiment 1, the refrigerant inlet 175 and the refrigerant outlet 177 are provided in the muffler cover 169 so that the flow direction of the refrigerant gas induced in the interior of the sealed container 101 according to the rotation of the electric component 103, and the flow direction of the refrigerant gas from the refrigerant inlet 175 to the refrigerant outlet 177 conform to each other in a macroscopic manner (as a whole).

By the gas flow X of the refrigerant gas induced in the interior of the sealed container 101 according to the rotation of the crankshaft 119, the refrigerant gas 111 in the first space is allowed to flow more actively in the first space. This facilitates the replacement of the refrigerant gas 111 in the first space. Since the low-temperature refrigerant gas 111 is introduced to the first space, it becomes possible to achieve advantages that the outer wall of the muffler boxy 165 which is closer to the electric component 103 can be cooled as well as the heat insulation. Because of this, the volumetric efficiency can be improved more effectively, and hence the efficiency of the sealed compressor 100 can be improved.

Although in Embodiment 1, the suction muffler 157 is configured such that the refrigerant gas 111 having returned from the refrigeration cycle is released to the interior of the sealed container 101 and then the refrigerant gas 111 is suctioned into the suction muffler 157, which is semi-direct suction method, the present invention is not limited to this. The same advantages can be achieved by the configuration of the present embodiment in a direct suction method in which the refrigerant gas 111 having returned from the refrigeration cycle is not released to the interior of the sealed container 101, but directly suctioned into the suction muffler 157.

INDUSTRIAL APPLICABILITY

A sealed compressor of the present invention is able to improve the suction efficiency of a suction muffler and the efficiency of the compressor, and therefore is widely applicable to refrigeration units in show cases, vending machines, etc., for business purposes, as well as electric refrigerators, air conditioners, etc., for household uses.

REFERENCE SIGNS LIST

100 sealed compressor
101 sealed container
103 electric component
105 compression component
107 compressor body
109 suspension ring
111 refrigerant gas
113 oil
115 suction pipe
117 opening
119 crankshaft
121 block
123 piston
125 joining means
127 eccentric shaft
129 main shaft
131 oil feeding mechanism
133 discharge pipe
135 high-pressure pipe
137 stator
139 rotor
141 compression chamber
143 cylinder
145 bearing unit
147 suction hole
149 valve plate
151 suction valve
153 cylinder head
155 head bolt
157 suction muffler
159 tail pipe
161 communication pipe
163 muffling space
165 muffler body
167 heat insulating layer
169 muffler cover
171 suction port
173 refrigerant receiver section
175 refrigerant inlet
177 refrigerant outlet
X flow direction of refrigerant gas

The invention claimed is:

1. A sealed compressor comprising:

an electric component;

a compression component actuated by the electric component;

a sealed container accommodating the electric component and the compression component; and a suction pipe which is provided to penetrate a wall portion of the sealed container, and through which a refrigerant gas suctioned into the sealed container flows;

wherein the compression component includes a compression chamber formed within a cylinder and a suction muffler through which the refrigerant gas flows from an interior of the sealed container to an interior of the compression chamber;

wherein the suction muffler comprises:

a muffler body in which a muffling space is formed;

a tail pipe through which the refrigerant gas is introduced into the muffling space;

a communication pipe of a tubular shape with a first end that opens in the muffling space, and a second end that communicates with the compression chamber; and a muffler cover provided to surround the muffler body such that a first space is formed between an inner wall of the muffler cover and an outer wall of the muffler body, wherein the tail pipe is provided such that a suction port which is a first end of the tail pipe opens in the interior of the sealed container and a second end of the tail pipe opens in the muffling space;

wherein the muffler cover is provided with a refrigerant inlet in a portion which faces an exit of the suction pipe and is in the vicinity of the suction port of the tail pipe, the refrigerant inlet communicating the interior of the sealed container with the first space; and wherein the first space encloses the muffling space.

2. The sealed compressor according to claim 1, wherein the muffler cover is further provided with a refrigerant flow path and a refrigerant outlet through which the refrigerant is discharged from the first space to the interior of the sealed container; and wherein the refrigerant inlet is provided in a location which is closer to the suction port of the tail pipe than the refrigerant outlet.

3. The sealed compressor according to claim 1, wherein the electric component is disposed below the compression component; and wherein the refrigerant inlet is provided in a portion of the muffler cover which is between the suction port of the tail pipe and the electric component.

4. The sealed compressor according to claim 2, wherein the refrigerant outlet is provided in a location of the muffler cover that is furthermost from the refrigerant inlet with respect to the refrigerant flowpath.

5. The sealed compressor according to claim 2, wherein a flow direction of the refrigerant gas induced in the interior of the sealed container according to a rotation of the electric component, and a flow direction of the refrigerant gas from the refrigerant inlet to the refrigerant outlet through the first space conform to each other in a macroscopic manner.

6. A sealed compressor comprising:

an electric component;

a compression component actuated by the electric component;

a sealed container accommodating the electric component and the compression component; and a suction pipe which is provided to penetrate a wall portion of the sealed container, and through which a refrigerant gas suctioned into the sealed container flows;

wherein the compression component includes a compression chamber formed within a cylinder and a suction muffler through which the refrigerant gas flows from an interior of the sealed container to an interior of the compression chamber;

wherein the suction muffler comprises:

a muffler body in which a muffling space is formed;

a tail pipe through which the refrigerant gas is introduced into the muffling space; and a muffler cover provided to surround the muffler body such that a first space is formed between an inner wall of the muffler cover and an outer wall of the muffler body, wherein the tail pipe is provided such that a suction port which is a first end of the tail pipe opens in the interior of the sealed container and a second end of the tail pipe opens in the muffling space;

wherein the muffler cover is provided with a refrigerant inlet in a portion which faces an exit of the suction pipe and is in the vicinity of the suction port of the tail pipe, the refrigerant inlet communicating the interior of the sealed container with the first space, wherein the muffler cover is provided with a refrigerant outlet through which the refrigerant is discharged from the first space to the interior of the sealed container, and wherein the first space encloses the muffling space.

* * * * *